United States Patent [19]

Bōdewein

[11] Patent Number: 4,658,685

[45] Date of Patent: Apr. 21, 1987

[54] DEVICE FOR LONGITUDINALLY CUTTING WEB MATERIAL, ESPECIALLY PAPER AND CARDBOARD WEBS

[75] Inventor: Jakob Bōdewein, Monchen-Gladbach, Fed. Rep. of Germany

[73] Assignee: Jagenberg Aktiengesellschaft, Dusseldorf, Fed. Rep. of Germany

[21] Appl. No.: 729,582

[22] Filed: May 2, 1985

[30] Foreign Application Priority Data

May 26, 1984 [DE] Fed. Rep. of Germany ..... 3419843

[51] Int. Cl.[4] ..... B26D 1/24

[52] U.S. Cl. ..... 83/302; 83/430; 83/500; 83/666; 83/675; 83/698

[58] Field of Search ..... 83/500–503, 83/430, 431, 666, 676, 698, 675, 596, 301, 302; 30/240, 347

[56] References Cited

U.S. PATENT DOCUMENTS

| | | | |
|---|---|---|---|
| 1,723,660 | 8/1929 | Ross | 83/500 |
| 3,415,148 | 12/1968 | O'Brien | 83/302 |
| 4,168,643 | 9/1979 | Takimoto et al. | 83/430 |
| 4,280,386 | 7/1981 | Ward, Sr. | 83/500 |

FOREIGN PATENT DOCUMENTS

| | | | |
|---|---|---|---|
| 667351 | 10/1938 | Fed. Rep. of Germany | 83/500 |

*Primary Examiner*—Frank T. Yost
*Assistant Examiner*—Hien H. Phan
*Attorney, Agent, or Firm*—Sprung Horn Kramer & Woods

[57] ABSTRACT

A device for longitudinally cutting web material, especially paper and cardboard webs with at least one rotating circular knife pair consisting of a freely rotating point knife that enters the material during the cutting process and a pot knife that rests on a power-rotated hub element. To reliably preserve, with simple means, an initial basic or zero adjustment subsequent to regrinding or replacement of the pot knife, the cutting surface of the pot knife rests axially against a contact surface that is stationary in relation to the hub element.

5 Claims, 3 Drawing Figures

DEVICE FOR LONGITUDINALLY CUTTING WEB MATERIAL, ESPECIALLY PAPER AND CARDBOARD WEBS

BACKGROUND OF THE INVENTION

The present invention relates to a device for longitudinally cutting web material, especially paper and cardboard webs with at least one rotating circular knife pair consisting of a freely rotating point knife that enters the material during the cutting process and of a pot knife that rests on a power-rotated hub element.

A longitudinal cutting device of the aforesaid type is known for example from U.S. Pat. No. 4,210,045. Devices of that type, in which the point and pot knives can, if necessary, be adjusted with setting mechanisms to a particular desired cutting position, operate satisfactorily in themselves. Still, problems arise when the pot knives have to be reground or replaced. The width of the knife, and hence the overall width of the cut, changes when a knife is reground.

It is especially expensive and time-consuming in double longitudinal cutting devices, in which two circular-knife pairs operate superimposed, to adjust the knife units in relation to each other when new or reground knife blades are mounted. The same is true of programmed longitudinal cutting devices, in which the knife units are strictly motor-adjusted. In this case the basic or zero position of the units must always be corrected to accord with the amount of material ground off of the blade.

SUMMARY OF THE INVENTION

The object of the present invention is to provide a device for longitudinally cutting web material, especially paper and cardboard webs, of the aforesaid type in which an initial basic or zero adjustment can, with simple means, be reliably preserved subsequent to regrinding or replacement of the pot knife.

This object is attained in accordance with the invention wherein the cutting surface of the pot knife rests axially against a contact surface that is stationary in relation to the hub element. This arrangement turns out to be a surprisingly simple means of ensuring that the cutting surface of the pot knife will remain unchanged because the cutting surface will always rest in the same plane against the contact surface whether or not and to whatever extent the pot knife is reground or exchanged.

In one practical embodiment of the invention the contact surface is positioned on a supporting ring connected with the hub element. This essentially simplifies mounting and dismounting the pot knife.

The contact surface in this embodiment can be an offset shoulder surface inside the circumference of the supporting ring.

The satisfactory integrity and orientation of the overall unit is facilitated in another embodiment of the invention wherein the side of the supporting ring that faces the hub element has a centering recess and the ring is fastened by means of the centering recess and of attachment screws to a flange mounted on the hub element and having a longer diameter than the hub element. The supporting ring and pot knife can then easily and rapidly be mounted in the form of a prefabricated subassembly to the hub element of the knife unit.

This embodiment is even more practical when the pot knife is positioned on the outside circumference of the flange on the hub element and has, distributed along its own circumference, perforations for set screws that rest in the supporting ring and can be screwed into a compression ring mounted on the flange and resting against the pot knife.

Some preferred embodiments of the invention will now be described with reference to the attached drawings, wherein:

DETAILED DESCRIPTION OF THE PREFERRED EMBODIMENTS

Figure 1:
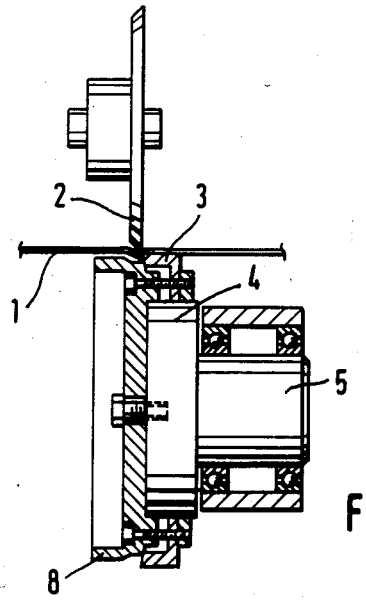
FIG. 1 is a schematic illustration of a circular-knife pair in a longitudinal cutting device in accordance with the invention.
Figure 2:
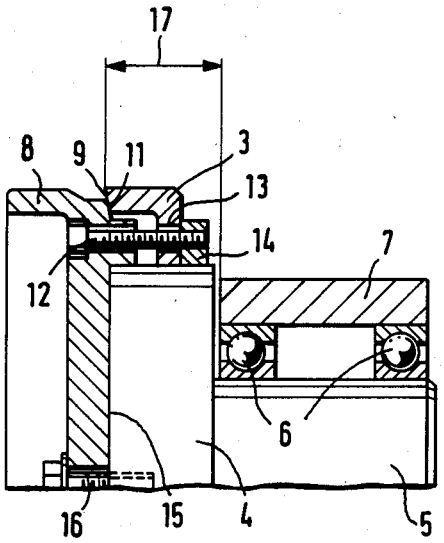
FIG. 2 is a partial longitudinal section through the pot knife in the form of an edge knife in accordance with FIG. 1.

Referring to FIGS. 1–2, a longitudinal cutting device, not illustrated in detail, has, to cut through a web 1 of material, a circular knife pair consisting of a freely rotating point knife 2 that enters the material during the cutting process and of a pot knife 3 that operates in conjunction with the point knife 2. Pot knife 3 rests on a flange 4 of a hub element 5 that is mounted through rolling elements 6 in such a way that it can rotate in a bearing bush 7. Pot knife 3 rests axially on the flange 4 of hub element 5 against a supporting ring 8.

How pot knife 3 is supported is demonstrated in greater detail by the edge-knife version illustrated in FIG. 2. As will be evident from the FIG. 2, the cutting surface 9 of the pot knife rests against a contact surface 11 that consists of an offset shoulder surface on supporting ring 8. Any new or reground pot knife 3 will constantly be tensioned against the contact surface 11 by set screws 12, which are distributed around the circumference of supporting ring 8, which extend through perforations 13 in the knife, and which are screwed into a compression ring 14. Supporting ring 8 itself has a centering recess 15 that engages the flange 4 on hub element 5. The ring 8 is mounted with attachment screws 16 on flange 4.

Supporting pot knife 3 against the contact surface 11 of supporting ring 8, in accordance with the invention, ensures that the distance 17 between the forward edge of bearing bush 7 and the cutting surface 9 of pot knife 3 will always remain constant even when a new pot knife is installed or when the existing knife is reground.

Figure 3:
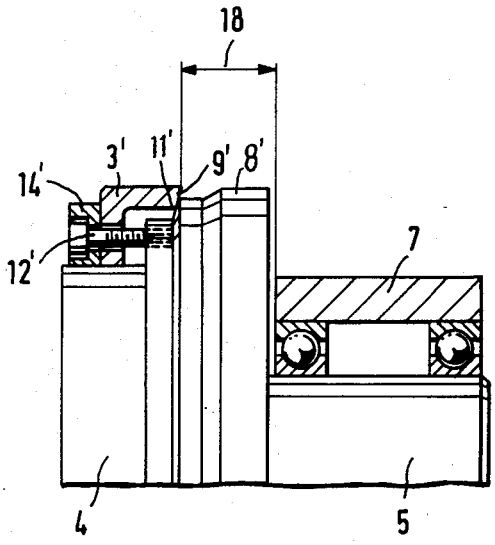
FIG. 3 is a partial longitudinal section through another embodiment of a pot knife utilizing the present invention.

The embodiment illustrated in FIG. 3 is similar in principle to that illustrated in FIG. 2 except that it uses a reverse order of elements in the circular knife unit. The contact on the part of the cutting surface 9 of pot knife 3 with the contact surface 11' of supporting ring 8' and the tension produced by compression ring 14' and set screws 12' again ensure that the distance 18 between the forward edge of bearing bush 7 and the cutting edge of cutting surface 9' will always remain constant.

It will be appreciated that the instant specification and claims are set forth by way of illustration and not limitation, and that various modifications and changes may be made without departing from the spirit and scope of the present invention.

What is claimed is:

1. In a device for longitudinally cutting web material, having at least one pair of rotating circular knives, each pair having a freely rotating point knife for entering the material during cutting, a pot knife having a radial portion and an axial portion with a circular cutting edge at the end of a radial cutting face thereof which is ground to sharpen the cutting edge and means for rotatably driving the pot knife including a rotatably driven hub element and means mounting the pot knife on the hub element to dispose the cutting edge in alignment with the point knife and for rotation with the hub element, the improvement wherein the means mounting the pot knife includes supporting means forming a contact surface extending generally radially outwardly from the hub element and stationary with respect to the hub element and facing the cutting face of the pot knife and compressing means abutting the radial portion of the pot knife such that the pot knife is disposed between the supporting means and the compressing means for axially forcing the cutting face of the pot knife against the contact surface, the hub element has a hub body and a flange having a larger diameter than that of the hub body, the supporting means has a centering recess on a side facing the hub element and means mounting the supporting means to the hub element comprising the centering recess and attachment screws connected to the flange.

2. A device as in claim 1, wherein the supporting means forming the contact surface comprises a supporting ring connected to the hub element.

3. A device as in claim 2, wherein the supporting ring has an offset shoulder surface constituting the contact surface.

4. A device as in claim 2, wherein the compressing means comprises perforations for set screws distributed along a radial portion of the pot knife, a compression ring mounted on the flange and resting against the pot knife, and set screws fixing the pot knife between the supporting ring and the compression ring.

5. A device as in claim 1, wherein the pot knife is positioned on an outside circumference of the flange on the hub element.

* * * * *